United States Patent [19]

Allbright

[11] Patent Number: 4,968,043

[45] Date of Patent: Nov. 6, 1990

[54] RECREATIONAL NET ASSEMBLY

[76] Inventor: Edwin T. Allbright, 3130 Lowell Blvd., Denver, Colo. 80211

[21] Appl. No.: 501,232

[22] Filed: Mar. 29, 1990

[51] Int. Cl.[5] ..... A63B 61/00

[52] U.S. Cl. ..... 273/411; 273/29 B; 273/181 F

[58] Field of Search ..... 273/411, 29 B, 29 BB, 273/29 BC, 26 A, 30, 181 R, 181 A, 181 F

[56] References Cited

U.S. PATENT DOCUMENTS 394,138 12/1888 Shepard ..... 273/29 B
4,415,168 11/1983 Schoenig ..... 273/411
4,523,760 6/1985 Bednarczuk ..... 273/181 F
4,703,931 11/1987 Steen ..... 273/411 X
4,842,284 6/1989 Rushing et al. ..... 273/411 X

*Primary Examiner*—William H. Grieb
*Attorney, Agent, or Firm*—Dorr, Carson, Sloan & Peterson

[57] ABSTRACT

A recreational net is formed with a plurality of loops extending along the lateral edges of the net by securing each end of a number of the horizontal strands of the net to itself at a predetermined distance from the end of the strand. The net is secured to two posts by extending each post through the loops along one of the lateral edges of the net.

17 Claims, 3 Drawing Sheets

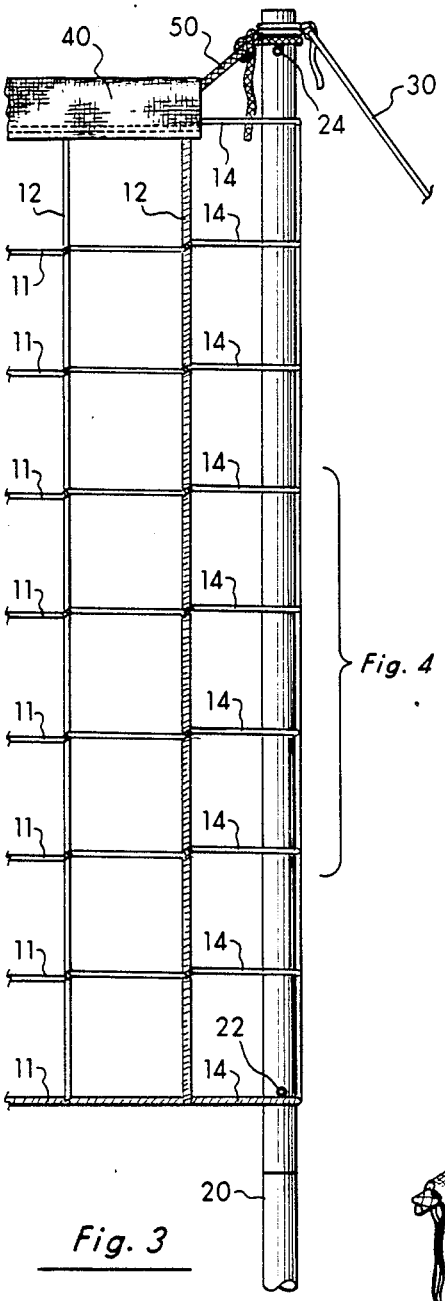
Fig. 3
Fig. 4
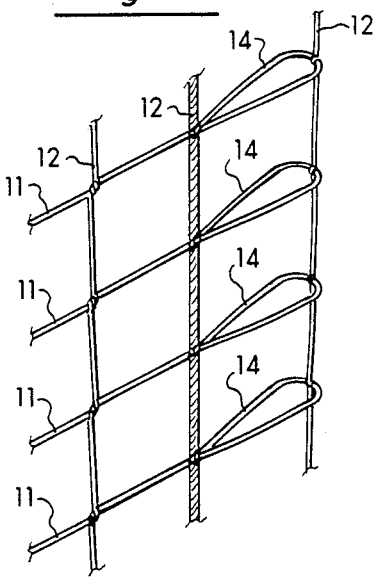
Fig. 5
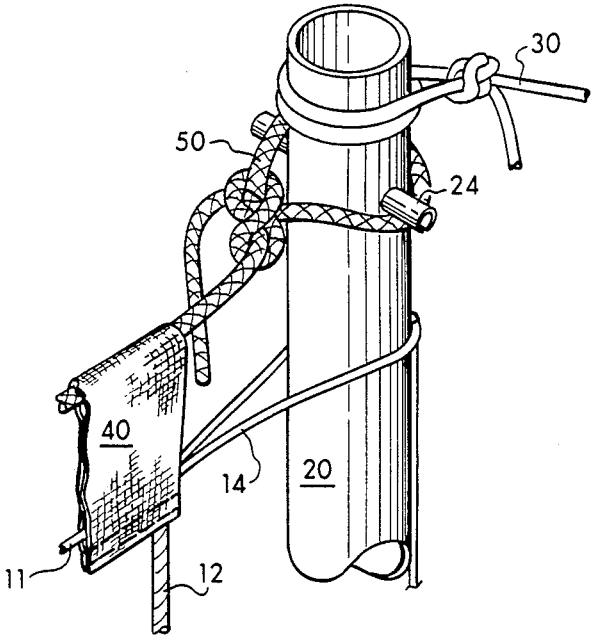

RECREATIONAL NET ASSEMBLY

BACKGROUND OF THE INVENTION

1. Field of the Invention

The present invention relates generally to the field of nets used in recreational sports, such as volleyball, tennis, and badminton. More specifically, the present invention discloses a recreational net in which the horizontal strands of the net are directly attached to the poles by a series of vertically-aligned loops formed by sewing the ends of each strand back upon themselves.

2. Statement of the Problem

A substantial number of different types of recreational nets are well known in the art. Volleyball nets are conventionally fashioned by permanently securing each set of lateral edges of the net mesh to a stretcher bar. The stretcher bars, in turn, are removably secured to the poles by cords or guy ropes. The stretcher bars add considerable weight and bulk to the net assembly and also substantially increase manufacturing costs.

The prior art contains several examples in which the lateral edges of various types of recreational nets are attached to a frame or pole by separate ties or laces in place of conventional stretcher bars, including the following:

| Inventor | Patent No. | Issue Date |
|---|---|---|
| Bednarczuk | 4,523,760 | June 18, 1985 |
| Steen | 4,703,931 | Nov. 3, 1987 |
| Rushing, et al. | 4,842,284 | June 27, 1989 |

The Rushing and Steen patents show different examples of sports nets in which the net is attached to a frame or pole by means of separate ties or laces. The advertisement on page 122 of the June 1976 issue of *The Sporting Goods Dealer* shows the same concept.

Bednarczuk discloses a net assembly in which the edges of the net are folded around the frame and back upon themselves to form loops. The loops are held in place by a separate lace 43 shown in FIG. 2 that is woven through the net mesh.

3. Solution to the Problem

None of the prior art references show a recreational net in which the lateral edges of the net are directly attached to the poles by a series of vertically-aligned loops formed by sewing the ends of the horizontal strands of the net back upon themselves. This construction completely eliminates the stretcher bars and shock cords commonly use to attach conventional volleyball nets to poles, and thereby provides substantial savings in term of weigh, manufacturing costs, and ease of assembly.

SUMMARY OF THE INVENTION

This invention provides a recreational net with a plurality of loops extending along the lateral edges of the net. Each loop is formed by securing one end of a horizontal strand of the net to itself at a predetermined distance from the end of the strand. The net is secured to two posts by extending each post through the loops along one of the lateral edges of the net.

A primary object of the present invention is to provide a recreational net assembly that is less expensive to produce than conventional nets.

Another object of the present invention is to provide a recreational net assembly that is lighter and more easily transported than conventional nets.

Yet another object of the present invention is to provide a recreational net assembly that has few components to be lost or broken.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 3 is a fragmentary front view corresponding to FIG. 1, showing a close-up of one end of the net and the upper portion of one of the poles.

FIG. 4 is a fragmentary front view of the net showing details of construction of several of the loops.

FIG. 5 is a fragmentary front view corresponding to FIG. 1, showing details of the attachment of the top rope and upper portion of the net to one of the poles.

DETAILED DESCRIPTION OF THE INVENTION

Figure 1:
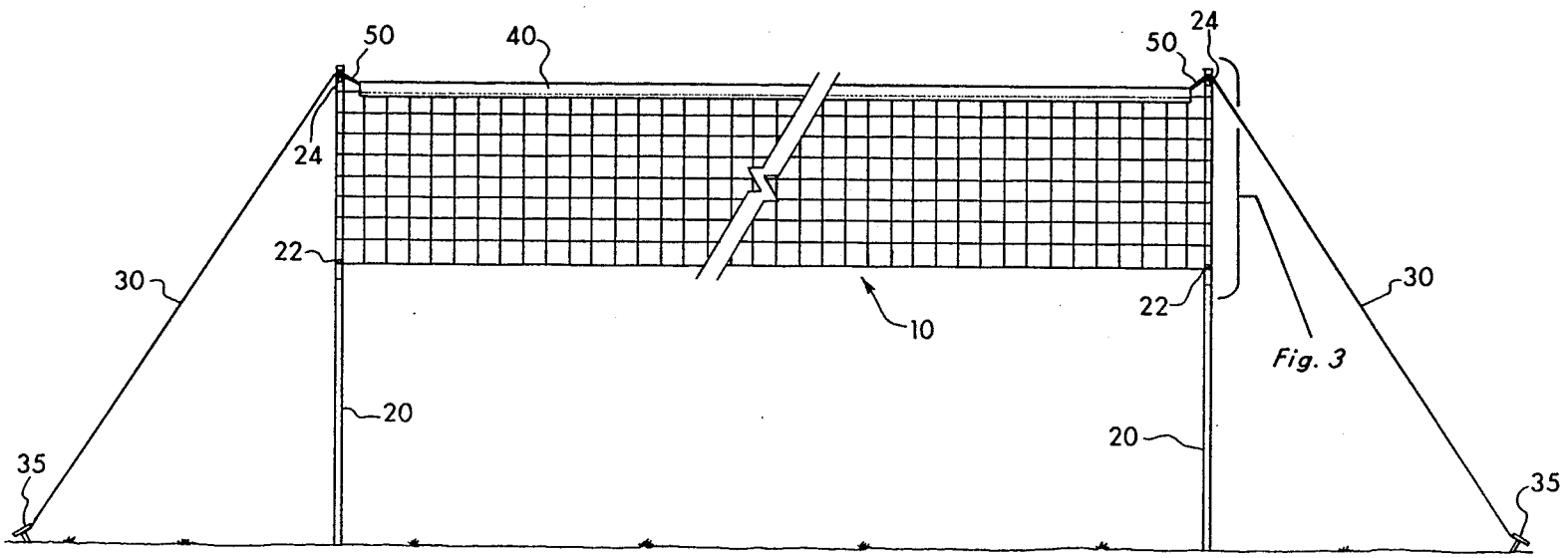
FIG. 1 is a front view showing the entire net assembly, including the net, poles, and support ropes.

Turning to FIG. 1., the present invention is shown in its fully assembled state. As with conventional recreational nets, the net 10 in the present invention is suspended between two vertical poles 20 extending upward from the ground. The poles are also supported in the conventional manner by a number of guy ropes 30 extending diagonally downward from the upper ends of the poles 20 to stakes 35 in the ground.

Figure 2:
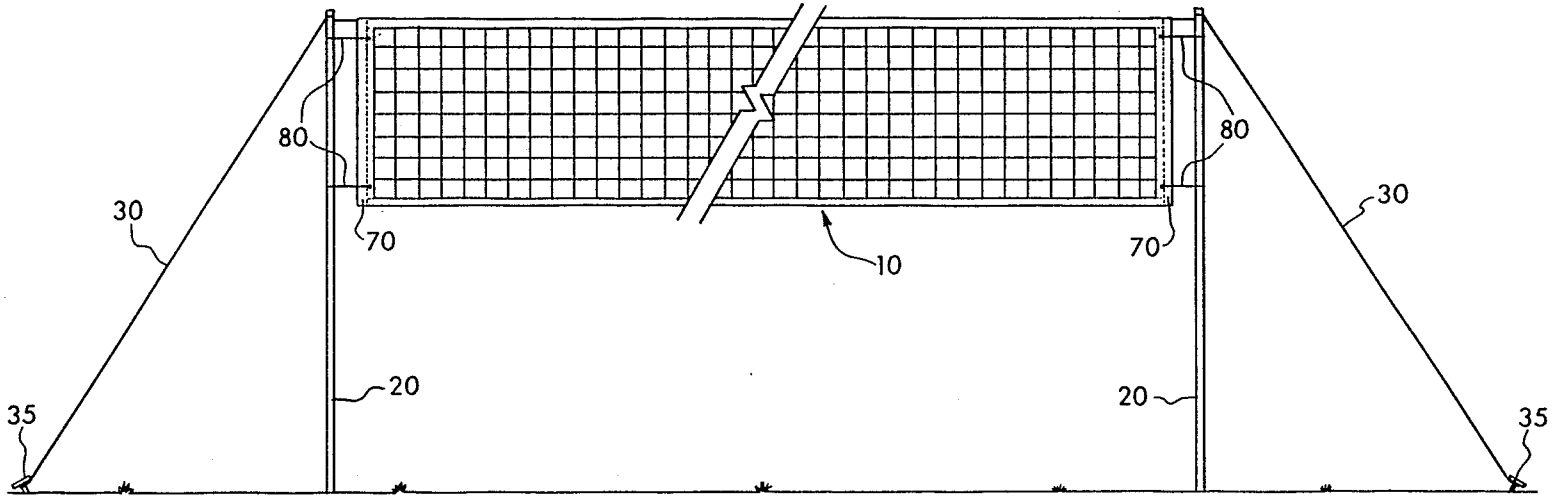
Fig. 2 Prior Art
FIG. 2 is a front view of a conventional volleyball net assembly showing stretcher bars attached to both ends of the net, with elastic shock cords securing the stretcher bars to the poles.

A conventional volleyball net is shown in FIG. 2. Each of the lateral edges of the net 10 are bound to a stretcher bar 70. The stretcher bars are commonly made of a strip of heavy cloth or vinyl which is folding into an elongated U-shape. The edges of the U-shape are sewn together with the lateral edge of the net in between to create an enclosed pocket extending vertically along the lateral edge of the net. A rigid member is inserted in this pocket to complete the stretcher bar assembly 70. The stretcher bars 70 are attached to the poles 20 by means of a series of elastic shock cords 80, each of which loop around one of the poles and through a hole in one of the stretcher bars. Additional vertical support is provided for the net by the top rope extending laterally along the top edge of the net, whose ends are tied to the tops of the poles 20.

The details of attachment between the net and poles in the present invention are shown in detail in FIGS. 3–5, and should be viewed in contrast to the prior art design shown in FIG. 2. The net mesh is conventional in nature, consisting of a plurality of horizontal strands 11 and a plurality of substantially vertical, orthogonal strands 12. A series of nodes exist where these horizontal and orthogonal strands intersect. In the preferred embodiment, a substantially rectangular net is employed. The loose ends of the horizontal strands are used to form a series of loops 14 in substantially vertical alignment with one another along both lateral edges of the net. This is accomplished by attaching each of the loose ends to the corresponding horizontal strand at a predetermined distance from its end, as shown in FIG. 4. This attachment can be accomplished by means of sewing, application of an adhesive, or by tying the loose ends to the horizontal strands. Additional strength and uniformity of the resulting loop size are achieved by attaching the ends to nodes in the net mesh.

After the loops are formed, two poles 20 are inserted through the loops 14 along both lateral edges of the net 10, as shown in FIG. 3. A number of pins 22 and 24 extending outward from the poles can be used to engage and retain some of the loops 14 to provide vertical support for the net assembly. Alternatively, a separate top rope 50 secured to the upper edge of the net by a binding 40 can be tied directly to the tops of the poles 20 above the top pin 24 for additional support, as shown in FIG. 5. As shown in FIG. 3, the distance between the upper pin 24 and the lower pin 22 is slightly greater than the height of the net. In the fully assembled state, the upper pin 24 provides an upward supporting force on the top rope 50 or the top horizontal strand, and the lower pin 22 exerts an opposing downward force on the bottom horizontal strand, thereby tending to keep the net fully unfurled. The length of the top and/or bottom horizontal strands can be less than the length of the remaining strands to provide additional tension to help insure that the net assembly remains fully spread.

The above disclosure sets forth a number of embodiments of the present invention. Other arrangements or embodiments, not precisely set forth, could be practiced under the teachings of the present invention and as set forth in the following claims.

I claim:

1. A recreational net assembly comprising:

a net with two opposing lateral edges having a plurality of strands extending from the first lateral edge to the second lateral edge, each of said strands having an end at both of said lateral edges;

a plurality of loops extending along the lateral edges of said net, each loop being formed by securing one end of one of said strands to said strand at a predetermined distance from said end; and two posts, each post extending through a number of said loops along one of the lateral edges of said net.

2. The recreational net assembly of claim 1 further comprising at least one pin extending outward from said posts, adapted to provide vertical support for a corresponding number of said loops.

3. The recreational net assembly of claim 1 wherein said posts each further comprise two pins extending outward from said post with a vertical spacing between said pins that is slightly greater than the distance between the top horizontal strand and the bottom horizontal strand of said net, said pins being adapted to engage the loops on said top and bottom horizontal strands to support and spread the net between said pins.

4. The recreational net assembly of claim 3 wherein the lengths of the top horizontal strand and bottom horizontal strand are less than the remaining horizontal strands of said net.

5. The recreational net assembly of claim 1 wherein said loops are formed by adhesive bonding of said ends to said strands.

6. The recreational net assembly of claim 1 wherein said loops are formed by sewing said ends to said strands.

7. The recreational net assembly of claim 1 wherein said net comprises a plurality of longitudinal strands extending between said lateral edges of said net and a plurality of orthogonal strands substantially perpendicular to said longitudinal strands forming a mesh with a node at each point where one of said longitudinal strands intersects one of said orthogonal strands, with each of said loops being formed by tying an end of one of said horizontal strands about a node on said horizontal strand.

8. A recreational net assembly comprising:

a net with two opposing lateral edges having a plurality of longitudinal strands extending from the first lateral edge to the second lateral edge, each of said strands having an end at both of said lateral edges; said net also having a plurality of orthogonal strands substantially perpendicular to said longitudinal strands forming a mesh with a node at each point where one of said longitudinal strands intersects with one of said orthogonal strands;

a plurality of loops extending along the lateral edges of said net, each loop formed by securing one end of one of said longitudinal strands to one of said nodes on the longitudinal strand at a predetermined distance from said end; and two posts, each post extending through a number of said loops along one of the lateral edges of said net.

9. The recreational net assembly of claim 8 further comprising at least one pin extending outward from said posts, adapted to provide vertical support for a corresponding number of said loops.

10. The recreational net assembly of claim 8 wherein said posts each further comprise two pins extending outward from said post with a vertical spacing between said pins that is slightly greater than the distance between the top horizontal strand and the bottom horizontal strand of said net, said pins being adapted to engage the loops on said top and bottom horizontal strands to support and spread the net between said pins.

11. The recreational net assembly of claim 10 wherein the length of the bottom horizontal strand is less than the remaining horizontal strands of said net.

12. The recreational net assembly of claim 8 wherein said loops are formed by adhesive bonding of said ends to said strands.

13. The recreational net assembly of claim 8 wherein said loops are formed by sewing said ends to said strands.

14. A recreational net assembly comprising:

a substantially rectangular net with a top edge and two opposing vertical edges, having a plurality of horizontal strands extending from the first vertical edge to the second vertical edge, each of said strands having an end at both of said vertical edges;

a first plurality of loops extending in substantial vertical alignment with one another along the first vertical edge of said net, each loop being formed by securing a first end of one of said horizontal strands to said strand at a predetermined distance from said first end;

a second plurality of loops extending in substantial vertical alignment with one another along the second vertical edge of said net, each loop being formed by securing the second end of one of said horizontal strands to said strand at a predetermined distance from said second end; and two posts, each post extending through a number of said loops along one of the vertical edges of said net.

15. The recreational net assembly of claim 14 further comprising at least one pin extending outward from said posts, adapted to provide vertical support for a corresponding number of said loops.

16. The recreational net assembly of claim 14 further comprising:

two pins, each pin extending outward from one of said posts; and a top rope attached along the top edge of said net, with two ends extending laterally outward beyond the lateral edges of said net and secured to said pins.

17. The recreational net assembly of claim 14 further comprising:

a substantially rectangular net with a top edge and two opposing vertical edges, having a plurality of horizontal strands extending from the first vertical edge to the second vertical edge, each of said strands having an end at both of said vertical edges;

a first plurality of loops extending in vertical alignment with one another along the first vertical edge of said net, each loop being formed by securing a first end of one of said horizontal strands to said strand at a predetermined distance from said first end;

a second plurality of loops extending in vertical alignment with one another along the second vertical edge of said net, each loop being formed by securing the second end of one of said horizontal strands to said strand at a predetermined distance from said second end;

two posts, each post extending through a number of said loops along one of the vertical edges of said net;

two upper pins, each pin extending outward from one of said posts;

a top rope attached along the top edge of said net, with two ends extending laterally outward beyond the lateral edges of said net and secured to said upper pins; and two lower pins, each pin extending outward from one of said posts at a predetermined distance below said upper pin, adapted to receive one of said loops and provide downward tension for said net.

* * * * *